United States Patent [19]

Woolley et al.

[11] 4,172,463

[45] Oct. 30, 1979

[54] DISHWASHER UPPER SPRAY AND DEFLECTOR DISC

[75] Inventors: James M. Woolley; Timothy J. Skinner, both of Dayton, Ohio

[73] Assignee: White Consolidated Industries, Inc., Cleveland, Ohio

[21] Appl. No.: 951,982

[22] Filed: Oct. 13, 1978

[51] Int. Cl.[2] ..... B08B 3/02

[52] U.S. Cl. ..... 134/176; 134/183; 239/251

[58] Field of Search ..... 134/176, 179, 183; 239/251

[56] References Cited

U.S. PATENT DOCUMENTS

| | | | |
|---|---|---|---|
| 603,580 | 5/1898 | Shaw | 134/183 UX |
| 2,602,003 | 7/1952 | Wellborn | 134/179 X |
| 3,709,236 | 1/1973 | Field et al. | 239/251 X |
| 3,809,106 | 4/1974 | Crabtree | 134/176 |
| 3,989,054 | 11/1976 | Mercer | 134/176 X |

*Primary Examiner*—Robert L. Bleutge

*Attorney, Agent, or Firm*—Pearne, Gordon, Sessions

[57] ABSTRACT

A dishwasher has a unitary spray and deflector disc member in spaced relation with its wash chamber top wall of a diameter so as to extend a sufficient distance across the chamber to intercept upwardly directed sprays of water. A diametrical spray conduit is incorporated with the disc including inlet means for accepting water from a top wall feed line for flow into two radial discharge streams to maintain the conduit full of water while exiting spray port means at each end of the conduit cause rotation of the disc. The water entering the disc inlet means and exiting the spray port means imparts stability to the disc to reduce the sound level within the chamber caused by impinging sprays thereon.

1 Claim, 7 Drawing Figures

DISHWASHER UPPER SPRAY AND DEFLECTOR DISC

This invention relates to dishwasher spray apparatus and more particularly to an improved upper rotary spray and water deflector disc.

In dishwashing apparatus cleaning chambers, it is desirable to reduce or minimize the noise level of the apparatus without effecting the fluid spray apparatus's ability for producing a thorough distribution of cleaning fluid to all parts of the dishwashing chamber or decreasing the usable wash chamber volume.

Accordingly, it is an object of the present invention to provide an improved unitary spray and deflector disc member rotatably supported for limited deflection in spaced relation with the top wall of a dishwasher chamber. The disc portion of the unitary member includes a flexible base wall and downwardly extending lip substantially coextensive with the periphery thereof. The disc member has a diameter such that it extends a sufficient distance across the dishwashing chamber to intercept the upwardly directed sprays of water from a distribution nozzle means before the spray directly impinges on the wash chamber top wall. First and second ribs extend substantially parallel to and equally spaced on opposite sides of a diametrical axis of the disc defining, with the disc base wall, an inverted disc channel therebetween. Each end of the channel is closed by end rib means adjacent the periphery of the disc base wall.

A cover portion sealingly encloses the channel to define a diametrical conduit substantially coextensive with the disc diametrical axis. Spray port means are located at each end of the conduit so as to be asymmetrically disposed on either side of the diametrical axis. Water inlet means are provided in the disc base wall concentric with its axis of rotation providing communication between a water feed line and the disc conduit with the inlet means of a predetermined size for accepting the incoming stream of water from the feed line and equally distribute the flow into two radial discharge streams sufficient to maintain the conduit full of water while exiting each spray port means whereby the stream of water from the feed line enters the conduit whenever water is being discharged upwardly from the nozzle means. Thus, water exiting each spray port of the channel causes the water to be sprayed outside the circle of rotation of the disc member for washing dishes and the like while providing the necessary reaction force for rotating the disc about its axis of rotation. The stream of water entering the disc inlet means and exiting the spray port means in accordance with the predetermined size of the inlet means further imparts sufficient stability to the spray and deflector disc member, such that the impinging force of water discharged upwardly to the underside of the disc from the distribution nozzle means is damped by limited deflection of the disc member. The result of applicants' novel apparatus is that sound level reduction is achieved within the wash chamber by obviating the direct impingement of the upwardly directed water from the distribution nozzle means on the chamber top wall.

Further objects and advantages of the present invention will be apparent from the following description, reference being had to the accompanying drawings wherein a preferred embodiment of the present invention is clearly shown.

Figure 1:
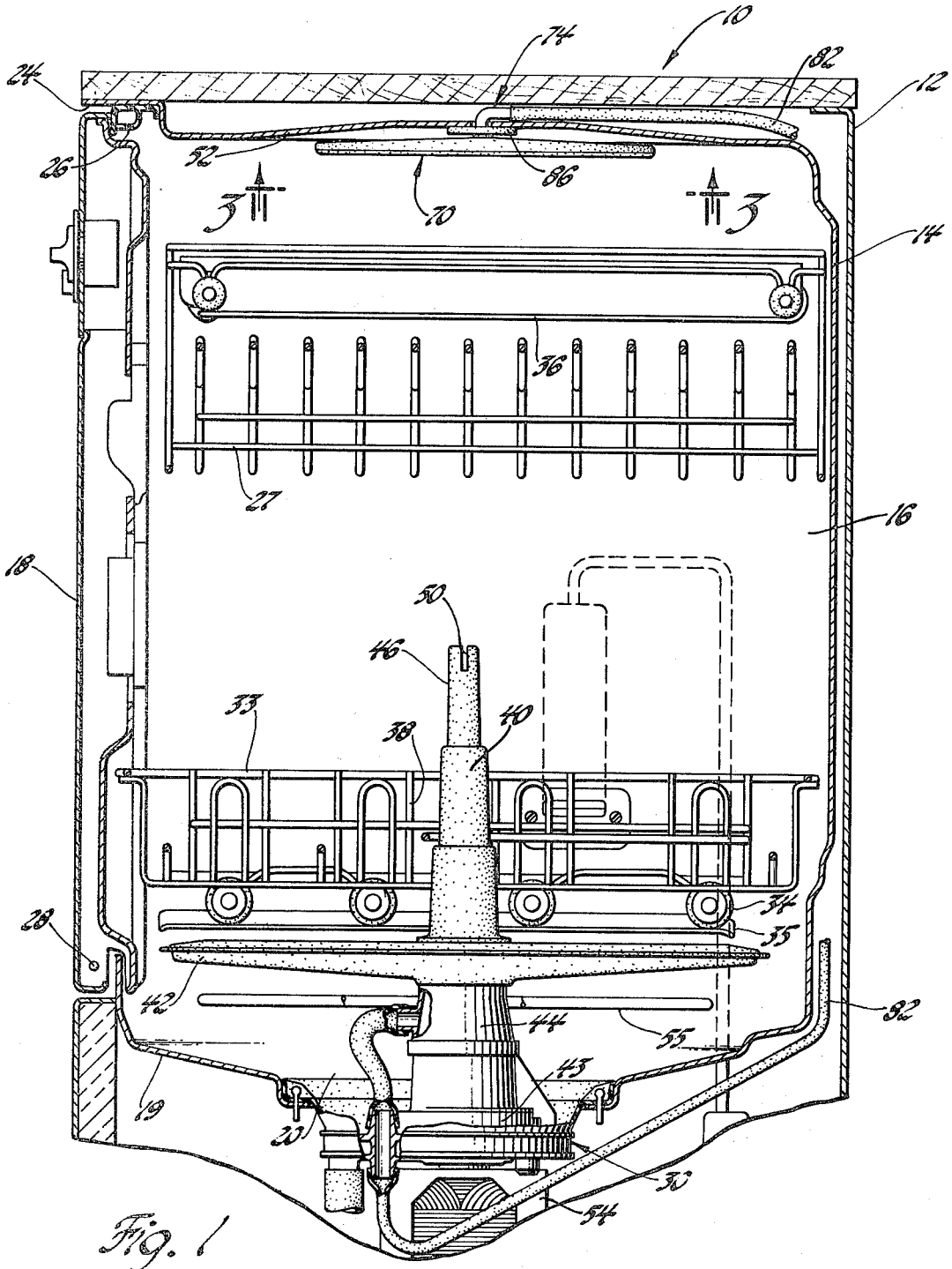
FIG. 1 is a view in vertical section of a domestic dishwasher including the present invention.

For the purpose of illustrating one application of the present invention, there is shown in FIG. 1 a portion of a domestic dishwasher illustrated generally at 10. The dishwasher 10 is comprised of casing means in the form of an outer casing 12 that surrounds an inner liner 14 defining a dishwashing chamber 16 closed at the front thereof by dishwasher door 18 and having a bottom wall 19 forming a depressed tub sump or liquid container 20 leading to a pump-motor assembly partially indicated at 30 which may be of the type taught in co-pending U.S. patent application Ser. No. (D-2,205) assigned to the same assignee as the present application.

The arm 42 has a downwardly opening inlet that circumscribes the top of an axial flow pump housing 44 of the pump and motor assembly as taught more particularly in U.S. Pat. No. 3,265,311.

The door construction of the closure 18 is conventional and may be of one type shown in U.S. Pat. No. 3,292,645. For the purpose of the present invention, it is merely necessary to indicate that it closes an access opening 24 of the dishwashing chamber 16 which has a peripheral seal 26 in surrounding relationship therewith that is positioned to engage the top and two sides of the closure 18.

Within the dishwashing space 16 is located an upper or top article containing rack 27 movable into and out of the chamber 16 through the opening 24. The closure 18 is pivotally mounted by means as pins 28 for forward and downward movement with respect to outer casing 12 to a point where a bottom rack 33 within the dishwashing chamber can be pulled outwardly thereof through the access opening 24. Suitable rollers such as nylon rollers 34 are provided that guide on stainless steel guides such as 35 for the lower rack and extension guides 36 for the upper rack which are screw fastened to the side walls of the dishwashing chamber. The lower rack 33 includes a guard portion 38 that surrounds an upstanding spray column or tube 40 of a fluid distributing system.

In general, the water distribution system includes a revolvable lower spray arm 42 beneath the lower dish rack 33. The arm 42 has a downwardly opening inlet that circumscribes the top of an axial flow pump housing 44 of the pump and motor assembly as taught more particularly in U.S. Pat. No. 3,265,311. A rotating spray column or spray tube 46 is affixed to the spray arm and extends upwardly through the guard portion 38 of the lower rack. The spray column 46 provides distribution means in communication with the sump 20 including nozzle means in the form of outlet 50 adapted to project direct sprays of water generally upwardly through the support wire network of the upper dish rack 27 toward the top wall 52 of the chamber for washing dishes or the like. A reversible motor 54 in the pump motor assembly 30 directly drives the pump 43 in one direction to recirculate the water for washing or rinsing, and, when reversed pumps the water to drain. A heater 55 provides recovery heat to the wash and rinse water for adding heat to the chamber for the drying cycle.

Figure 2:
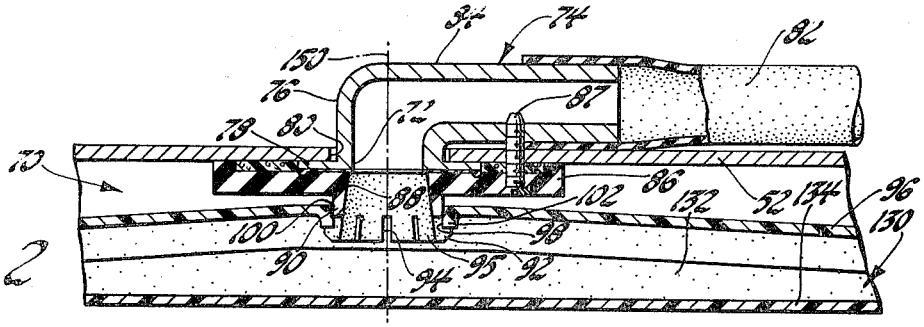
FIG. 2 is a fragmentary enlarged vertical sectional view through the top wall of the wash chamber showing the connection between the water feed line and the upper spray and deflector disc.

The present invention concerns a rotatable spray and deflector disc member 70 that is secured on the top wall 52 adjacent the exit end 72 of feed line means in the form of a right-angle elbow-like nipple 74. As seen in FIG. 2, the nipple has its downwardly directed portion 76 extending through top wall 52 and is formed with a peripheral flange 78 underlying a central opening 80 in top wall 52. The nipple 74 is supplied with water from the pump 43 by means of a flexible hose 82 that extends toward a rear corner of the cabinet structure and up through the space between the outer casing 12 and the inner tub or liner 16. At the top the hose 82 is fitted onto radially extending portion 84 of the nipple.

FIG. 2 shows a bushing 86 suitably affixed to the top wall as by screws 87 having an upwardly converging passage 88 circumscribed with a cylindrical flange 90 terminating in an outwardly flared shoulder portion 92. The shoulder portion has a plurality of circumferentially spaced vertical slots 94 defining resilient beveled tabs 95 for the receptive water inlet means of base wall 96. The water inlet means is in the form of a circular opening 98 having a beveled upper edge 100 for inward flexing of the tabs 95 the shoulder portions 92 of which spring outwardly to lock depending rim 102 of the spray disc 70 on the bushing 86.

As best seen in FIGS. 3–7 the spray and deflector disc member 70 is preferably of plastic material and includes the flexible base wall 96 formed with a downwardly extending lip 110 substantially coextensive with the periphery of the base well. It will be noted in FIG. 1 that the disc member 70 is of a diameter so as to extend a sufficient distance across the dishwashing chamber 16 to intercept the upwardly directed sprays of water from the distribution nozzle means 50 before the sprays directly impinge on the top wall 52 of the wash chamber.

Figure 3:
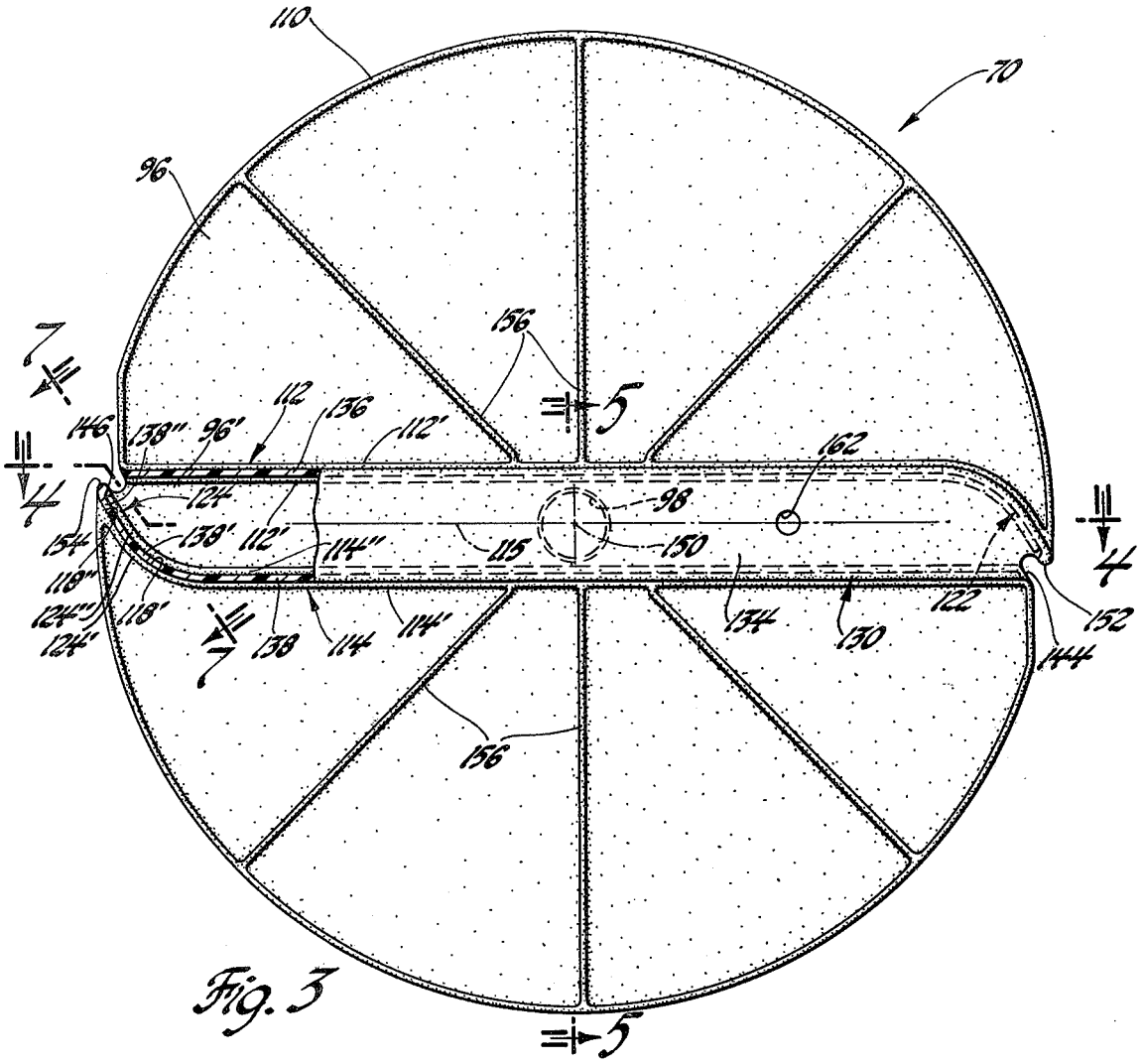
FIG. 3 is an enlarged elevational view of the underside of the upper spray and deflector disc with parts of the channel cover portion broken away to show the left hand spray port.
Figure 5:
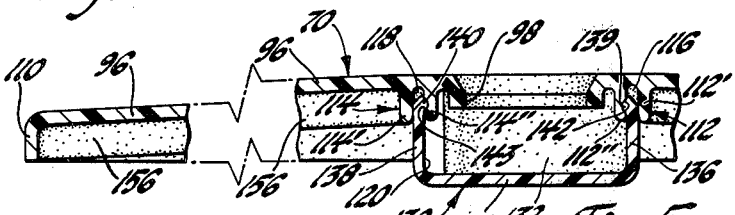
FIG. 5 is a vertical fragmentary sectional view taken substantially on the line 5—5 of FIG. 3.

FIGS. 3 and 5 show first 112 and second 114 rib means on the underside of the disc base wall 96' with the rib means 112, 114 extending substantially parallel to and equally disposed on opposite sides of diametrical axis 115 of the disc member defining with the disc base wall portion 96' formed intermediate thereof an inverted disc channel 120 therebetween. In the disclosed embodiment the rib means 112, 114 are each in the form of a first pair of ribs 112', 112" and a second pair of ribs 114', 114" defining parallel longitudinal first and second grooves 116 and 118 respectively, therebetween.

Each end of the channel is closed by end rib means 122 and 124 adjacent the periphery of the disc base wall 96. In the preferred form the right hand end rib means 122 is an arcuate extension of the linear rib means 112 while the left hand end rib means 124 is an arcuate extension of the second linear rib means 114. Thus, right hand end rib means 122 is composed of arcuate rib portions 122' and 122" and the left hand end rib means is composed of arcuate rib portions 124' and 124". In this manner first longitudinal groove 116 terminates in an arcuate portion 116' and a tangent portion 116" while the second longitudinal groove 118 terminates in an arcuate portion 118' and a tangent portion 118".

Figure 6:
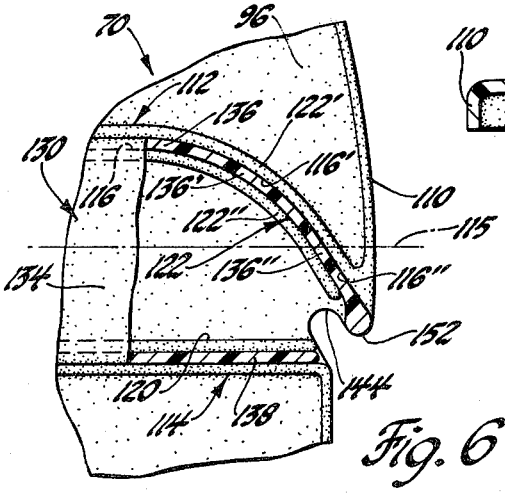
FIG. 6 is an enlarged fragmentary elevational view of the right hand spray port of the spray and deflector disc.
Figure 7:
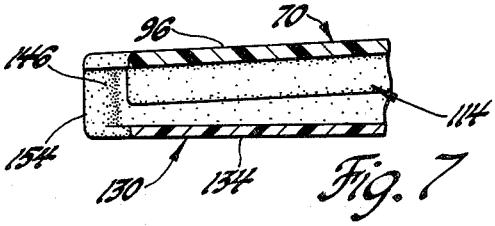
FIG. 7 is a fragmentary vertical sectional view of the spray arm and disc left hand spray port taken substantially on line 7—7 of FIG. 3.

As best seen in FIGS. 3 and 5, a cover portion, generally indicated at 130, sealingly encloses the channel 120 to define a diametrical conduit 132 substantially coextensive with said disc diametrical axis 115. In the preferred form the cover portion 130 is U-shaped in section providing a bight portion 134 having upstanding longitudinally extending first and second side wall portions 136 and 138. It will be noted in FIG. 5 that each wall portion 136, 138 has inwardly directed projections 139 and 140 respectively, coextensive with its associated wall portion. In a similar manner each inner rib 112" and 114" is formed with a notch 142 and 143 respectively conforming to the projections 139, 140 such that the cover wall portions 136 and 138 are lockingly and sealingly retained in their associated first and second grooves 116 and 118 in a watertight manner. As best seen in FIGS. 3, 6 and 7, right and left hand spray port means are provided which in the disclosed form are spray ports 144 and 146. It will be noted that the spray ports 144, 146 are located at each end of the conduit 132 so as to be asymmetrically disposed on either side of the diametrical axis 116.

It will thus be seen that by virtue of the abovedescribed arrangement the inlet means 98 is of a predetermined size for accepting the incoming stream of water from the feed line 82 and equally distributing the flow into two radial discharge streams sufficient to maintain the conduit 132 full of water exiting each spray port means 144 and 146. It will be noted that the stream of water from the feed line 82 enters the conduit 132 through the inlet 98 whenever water is being discharged from the nozzle 50.

The result is that water exiting each spray port 144, 146 causes water to be sprayed outside the circle of rotation of the disc member 70 for washing dishes and the like while providing the necessary reaction force for rotating the disc member about its axis of rotation 150.

With reference to FIG. 3 it will be seen that the spray ports 144 and 146 are angularly disposed by virtue of being defined by the vertically oriented edges 152 and 154 or arcuate-shaped deflecting end wall portions 136', 138' of side wall portions 136 and 138, respectively. The arcuate-shaped deflector end wall portions 136' and 138' are mirror images of each other and terminate in linear tangent portions 136" and 138", respectively positioned at an angle of about 60° with the diametrical axis 115. The arcuate-shaped end wall deflectors 136' and 138' provide reaction forces on the spray ports 144, 146 to create the driving torque for the desired speed of rotation of the spray and deflector disc.

It will be noted that the base wall 96 of the spray and deflector disc has integrally formed radiating ribs 156 aligned on the rotational axis 150 of the spray and deflector disc which ribs provide rigidity for the disc base wall. In addition the radiating ribs 156, which extend from the rib means 112 and 114 to the peripheral lip 10 act as blades for deflecting the upwardly directed water from the nozzle means 50 to assist in imparting rotational movement of the spray and deflector disc.

Thus, applicants' spray and deflector disc provides a wide angle spray of water that extends outwardly of its circle of rotation. The result is that the impinging force of water on the underside of the spray and deflector disc member from the distribution nozzle means 50 is dampened by limited deflection of the disc member thereby providing sound level reduction within the chamber 16 by obviating the direct impingement of water on the chamber top wall 52 from the distribution nozzle means 50.

Figure 4:
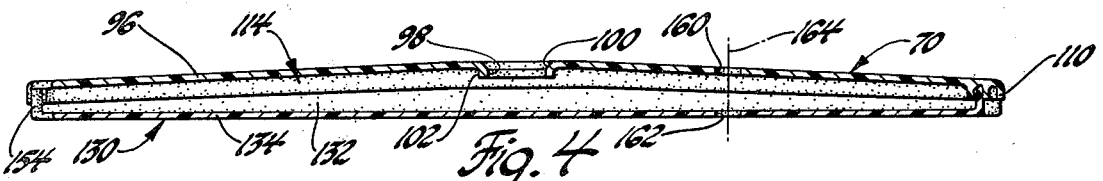
FIG. 4 is a vertical sectional view taken substantially on the line 4—4 of FIG. 3.

It will be noted in FIGS. 3 and 4 that additional upper and lower exit ports 160 and 162 are formed in the base wall 96 and the cover bight portion 134 respectively. The ports 160 provide an upwardly directed spray and the port 162 provides a downwardly directed spray substantially on the vertical offset axis 164.

While the embodiment of the invention as herein disclosed constitutes a preferred embodiment, it is to be understood that other forms might be adopted.

The embodiments of the invention in which an exclusive property or privilege is claimed are defined as follows:

1. In combination, casing means defining a dishwashing chamber having a top wall, side walls and sump adapted to contain water, distribution means in communication with said sump including nozzle means for directing sprays of water upwardly toward the top wall of said chamber for washing dishes or the like, feed line means in communication with said distribution means for directing water through aperture means in said top wall, securing means on said top wall adjacent the exit end of said feed line means for rotatably supporting with limited deflection a unitary spray and deflector disc member in spaced relation with the top wall of said chamber, said disc member including a flexible base wall and a downwardly extending lip substantially coextensive with the periphery of said base wall, said disc member of a diameter so as to extend a sufficient distance across the dishwashing chamber to intercept the upwardly directed sprays of water from said distribution nozzle means before said sprays directly impinge on said top wall, first and second side rib means on the underside of said disc base wall, said base wall first and second side rib means extending substantially parallel to and equally spaced on opposite sides of a diametrical axis of said disc member defining with said disc base wall an inverted disc channel therebetween, each end of said channel closed by end rib means adjacent the periphery of said disc base wall, a cover portion sealingly enclosing said channel to define a diametrical conduit substantially coextensive with said disc diametrical axis, spray port means located at each end of said conduit so as to be asymmetrically disposed on either side of said diametrical axis, water inlet means in said disc base wall concentric with the axis of rotation of said disc member providing communication between said feed line means and said disc conduit, said inlet means of a predetermined size for accepting the incoming stream of water from said feed line and equally distributing the flow into two radial discharge streams sufficient to maintain said conduit full of water while exiting each said spray port means, said stream of water from said feed line entering said conduit through said inlet means whenever water is being discharged from said nozzle means, the water exiting each said spray port means causing water to be sprayed outside the circle of rotation of said disc member for washing dishes and the like while providing the necessary reaction force for rotating said disc member about its axis of rotation, the stream of water entering said disc inlet means and exiting said spray port means in accordance with the predetermined size of said inlet means further imparting sufficient stability to said spray and deflector disc member, whereby the impinging force of water on the underside of said disc member from said distribution nozzle means is dampened by limited deflection of said disc member thereby providing sound level reduction within said chamber by obviating the direct impingement of water on said chamber top wall from said distribution nozzle means.

* * * * *